US006949030B1

(12) United States Patent
Gauer

(10) Patent No.: US 6,949,030 B1
(45) Date of Patent: Sep. 27, 2005

(54) GOLF SWING TRAINING AID

(76) Inventor: Robert Gauer, 19 Sherman Rd., Glen Cove, NY (US) 11542

( * ) Notice: Subject to any disclaimer, the term of this patent is extended or adjusted under 35 U.S.C. 154(b) by 0 days.

(21) Appl. No.: 10/833,247

(22) Filed: Apr. 27, 2004

(51) Int. Cl.[7] ..... A63B 69/36
(52) U.S. Cl. ..... 473/257; 473/219
(58) Field of Search ..... 473/257, 261, 473/264, 265, 219

(56) References Cited

U.S. PATENT DOCUMENTS

| | | | |
|---|---|---|---|
| 1,854,392 | A | 4/1932 | Bambrick |
| 3,375,010 | A | 3/1968 | Panza |
| 3,460,837 | A | 8/1969 | Cassa, Jr. |
| 3,554,555 | A | 1/1971 | Macri |
| 3,942,802 | A | 3/1976 | Wright |
| 3,975,024 | A | 8/1976 | Stephan |
| 4,082,287 | A | 4/1978 | Berkey |
| 5,069,456 | A | 12/1991 | Bellagamba |
| 5,263,719 | A | 11/1993 | Bunn |
| 5,346,220 | A | 9/1994 | Cooper et al. |
| 5,433,445 | A | 7/1995 | Melancon |
| 5,503,395 | A | 4/1996 | Cook |
| 5,513,842 | A | 5/1996 | Fuss |
| 5,899,816 | A | 5/1999 | Pearson |
| 5,961,393 | A | 10/1999 | Heller et al. |
| 6,390,930 | B1 | 5/2002 | Gauer |

FOREIGN PATENT DOCUMENTS

| | | |
|---|---|---|
| GB | 2197210 | 5/1988 |
| WO | WO 85/00295 | 1/1985 |

*Primary Examiner*—Raleigh W. Chiu
(74) *Attorney, Agent, or Firm*—Gerald E. Hespos; Anthony J. Casella

(57) ABSTRACT

A golf swing training guide device for training a golfer's golf swing. This golf swing training guide includes a stand, a telescoping arm coupled to the stand, an extending arm and a flexible swing guide member which can be selectively coupled to the extending arm. This device can be formed in at least two different embodiments. In both of the embodiments, the device can be stored in a compact manner before putting the device in use.

16 Claims, 5 Drawing Sheets

GOLF SWING TRAINING AID

BACKGROUND OF THE INVENTION

The invention relates to a golf swing training device. This device can be in the form of a guide for a swing plane of a user's golf swing. Other golf swing training guides are known in the art. For example the following U.S. patents are known golf swing training guides: U.S. Pat. No. 6,390,930 to Gauer; U.S. Pat. No. 1,854,392 issued on April, 1932 to Bambrick; U.S. Pat. No. 3,375,010 issued on March, 1968 to Panza; U.S. Pat. No. 3,460,837, issued on August, 1969 to Cassa, Jr.; U.S. Pat. No. 3,554,555 issued on January, 1971 to Maori; U.S. Pat. No. 3,942,802 issued on March, 1976 to Wright; U.S. Pat. No. 3,975,024 issued on August, 1976 to Stephan; U.S. Pat. No. 4,082,287 issued on April, 1978 to Berkey; U.S. Pat. No. 5,069,456 issued on December, 1991 to Bellagamba, U.S. Pat. No. 5,263,719 issued on November, 1993 to Bunn; U.S. Pat. No. 5,346,220 issued on September, 1994 to Cooper et al; U.S. Pat. No. 5,433,445 issued on July, 1995 to Melancon; U.S. Pat. No. 5,503,395 issued on April, 1996 to Cook; U.S. Pat. No. 5,513,842 issued on May., 1996 to Fuss. U.S. Pat. No. 5,899,816 issued on May., 1999 to Pearson; U.S. Pat. No. 5,961,393 issued in October, 1999 to Heller et al; wherein all of the disclosures of these references are incorporated herein by reference.

In addition, other references are known, such as Great Britian patent GB 2197210 issued on May., 1988; and PCT application WO 85/00295 published in January, 1985.

SUMMARY OF THE INVENTION

The invention relates to a device for golf instruction comprising a base, at least one telescoping arm coupled to the base, at least one bracket, and at least one selectively adjustable hinge coupling the bracket to the telescoping arm. This selectively adjustable hinge is for selectively adjusting the bracket to at least two different angles. There is at least one extending arm coupled to the bracket and at least one flexible swing guide member which can be selectively coupled to the extending arm wherein a user can swing a golf club along a swing path to avoid these flexible swing guide members to follow a particular swing path.

There can also be an additional extending arm coupled to bracket extending out from an opposite side of the bracket. In addition, as an option, the device can further comprise at least one additional rotatable hinge coupled to the telescoping arm opposite the first hinge. This additional hinge can be for coupling the telescoping arm to the base. In addition the device is for selectively adjusting an angle at which the arm is coupled to the base.

In one optional embodiment, the device can further comprise a level coupled to the bracket for determining the position of the extending arm with respect to a substantially horizontal surface.

The flexible guide members can be connected such that there can be multiple guide members such as four guide members on each extending arm extending out from the bracket. In this way the guide members can provide a substantially continuous guide for a golf club.

There can also be a holding element coupled to the stand, wherein the holding element is for coupling the flexible swing guide to the stand before attaching the flexible swing guide to an extending arm.

There can also be a swing trainer which can be in the form of a vertically extending swing guide comprising a base and a substantially vertically extending arm. This vertically extending swing guide can be placed adjacent to the flexible swing guide member to guide a user's swing in a substantially vertical manner until it extends underneath the swing guide.

One optional feature of this design, is that the vertically extending arm can be in the form of a telescoping arm that extends up from the base.

In addition, to adjust the angle of this vertically extending guide, there can be a hinge coupling the arm to the stand. This hinge allows the arm to be adjusted to a position off from an exact vertical position.

In one embodiment, there can also be a connecting extending arm, and a folding hinge, wherein the folding hinge connects the connecting extending arm to the extending arm. This allows the device to have a wider reach then would otherwise be available.

Other optional features are that these flexible guide members can be in the form of flexible rods or in the form of flexible slats which can be made from any known flexible material such as rubber or plastic.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
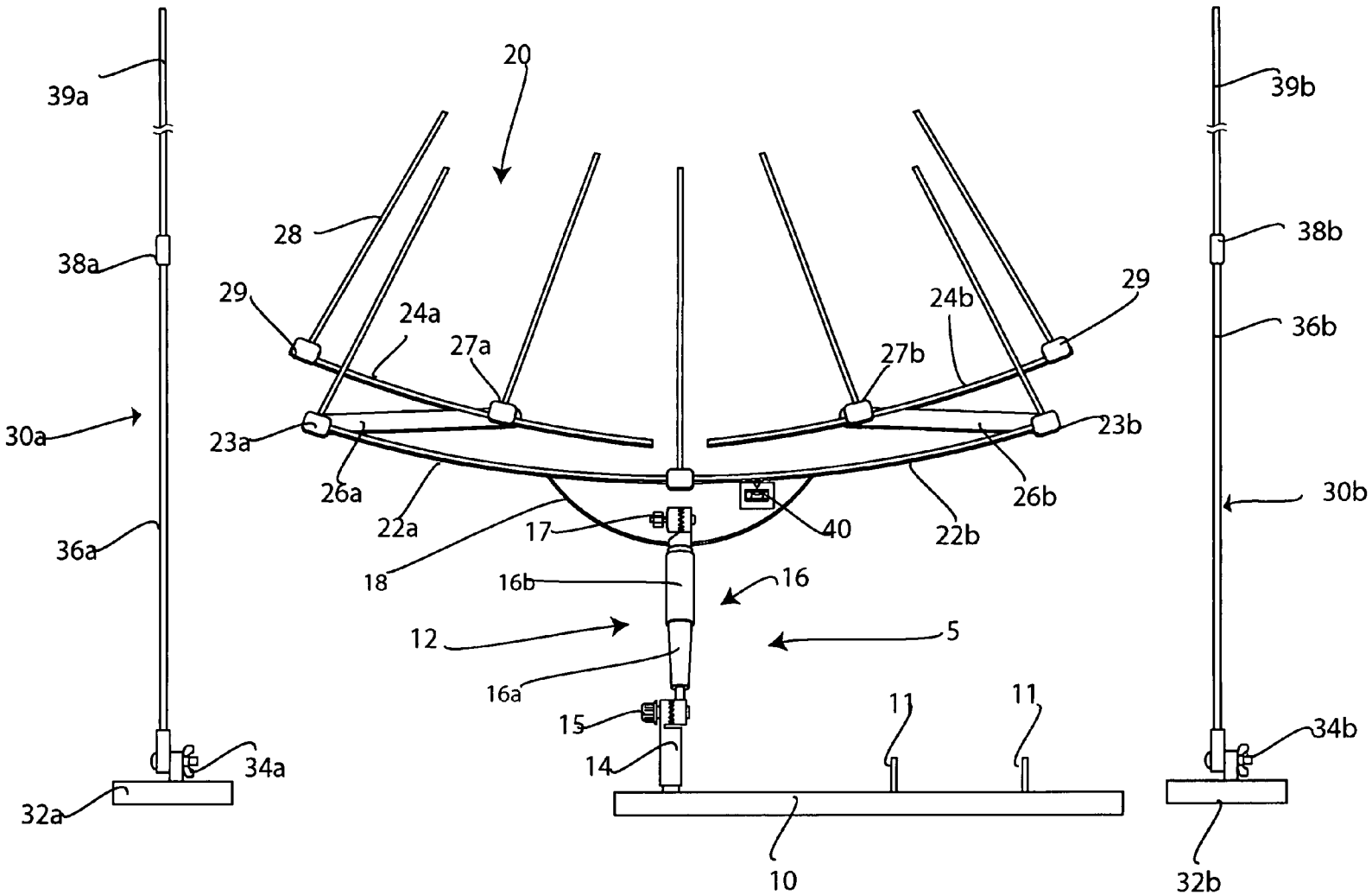
FIG. 1 shows a top view of the device in a closed form.

Turning now in detail to the drawings, FIG. 1 shows a side view of a device 5, having a base 10 which can be a substantially rectangular shaped base having at least two arms extending out therefrom. Arms 11 can be used to secure two separate swing trainers 30*a* and 30*b* to base 10. In addition, extending out from base 10 is an extension arm 12, which includes a preliminary extension arm 14, and rotatable hinge 15 which allows extension arm 12 to rotate. In addition, coupled to rotatable hinge 15 is a second extension arm 16 which is formed as a telescoping extension arm having an inner arm 16*a* and an outer arm 16*b*; wherein inner arm 16*a* slides within outer arm 16*b*. An additional rotatable hinge 17 is coupled to second extension arm 16. Coupled to rotatable hinge 17 is a bracket 18.

Bracket 18 is a substantially flat extending bracket which allows a guide 20 to be attached thereto. Guide 20 comprises extension arms 22*a* and 22*b*, coupled to bracket 18. Laterally extending arms 22*a* and 22*b* extend laterally out on either side of a central region associated with extension arm 12. Coupled to laterally extended arms, 22*a* and 22*b*, are hinges 23*a* and 23*b*.

Coupled to hinges 23*a* and 23*b*, respectively, are additional or intermediate extending or coupling arms 24*a* and 24*b*. Arms 24*a* and 24*b* are rotatably secured to arms 22*a* and 22*b*, respectively. Coupled to arms 24*a* and 24*b* are hinges, 27*a* and 27*b*, respectively. Coupled to hinges 27*a* and 27*b* are outer extending arms, 26*a* and 26*b*, respectively. In addition, coupled to guide 20 is a guide means such as flexible guide arms 28 which are coupled to these laterally extending arms 22*a*, 22*b*, 24*a*, 24*b*, 26*a* and 26*b* via coupling elements 29. These guide elements are flexible to allow a golf club to pass there through. In addition, these guide elements help guide the user's golf club below a particular level to guide the user into following a particular swing path.

In addition, disposed adjacent to base 10 and guide 20 are two swing trainers 30*a* and 30*b*. Essentially swing trainers 30*a* and 30*b* comprise associated bases 32*a* and 32*b*, and hinges 34*a* and 34*b*, coupled to bases 32*a* and 32*b*, respectively. Coupled to hinges 34*a* and 34*b* are arms 36*a* and 36*b*, respectively. Essentially, hinge 34*a* and 34*b* allow the swing trainer to be adjustable such that these swing trainers can extend out at a particular angle relative to bases 32*a* and 32*b*, respectively. There is also an additional coupling element or coupler, 38*a* and 38*b*, coupled to arms 36*a* and 36*b*, respectively. Couplers 38*a* and 38*b* allow additional extending arms, 39*a* and 39*b* to be optionally coupled to these swing trainers.

Swing trainers are essentially created to keep the user's golf club in a particular swing path such that, as long as the user's golf club extends along this swing path, the user will automatically learn the proper golf swing. In addition, there is also a level 40 coupled to bracket 18 wherein level 40 is used to show the user the precise positioning of this golf swing training device relative to a horizontal surface.

Figure 2:
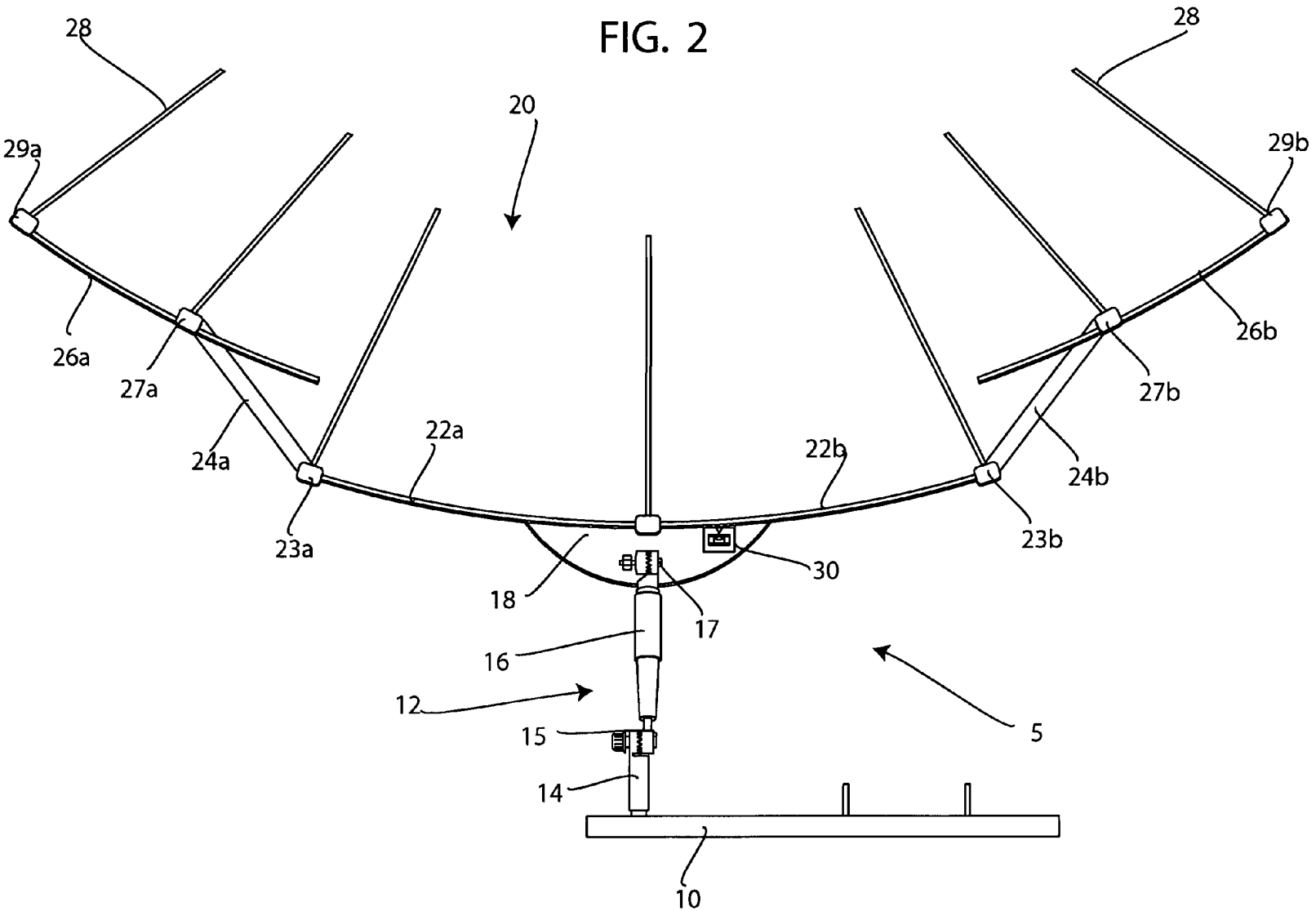
FIG. 2 shows a side view of the device in its expanded form.

FIG. 2 shows a side view of the device shown in FIG. 1. In this view, there is shown guide 20 which extends substantially horizontally out from base 12. Guide 20 is adjustable with regard to its position in two ways. First, guide 20 is adjustable via rotatable hinge 15 and also second hinge 17. Rotatable hinge 15 allows second extension arm 16 to rotate up from a substantially horizontal position to a substantially vertical position. This rotation causes guide 20 to move up and also towards base 10. In addition, the angle at which guide 20 is in relation to a horizontal surface can be adjusted via second rotatable hinge 17. This rotatable hinge can be used to rotate guide 20 from a substantially horizontal position to a substantially vertical position in relation to a horizontal hitting surface. In this view, guide elements 28 are shown extending out from the inner, middle and outer arms thereby helping to define a swing path for a golf club.

Figure 3:
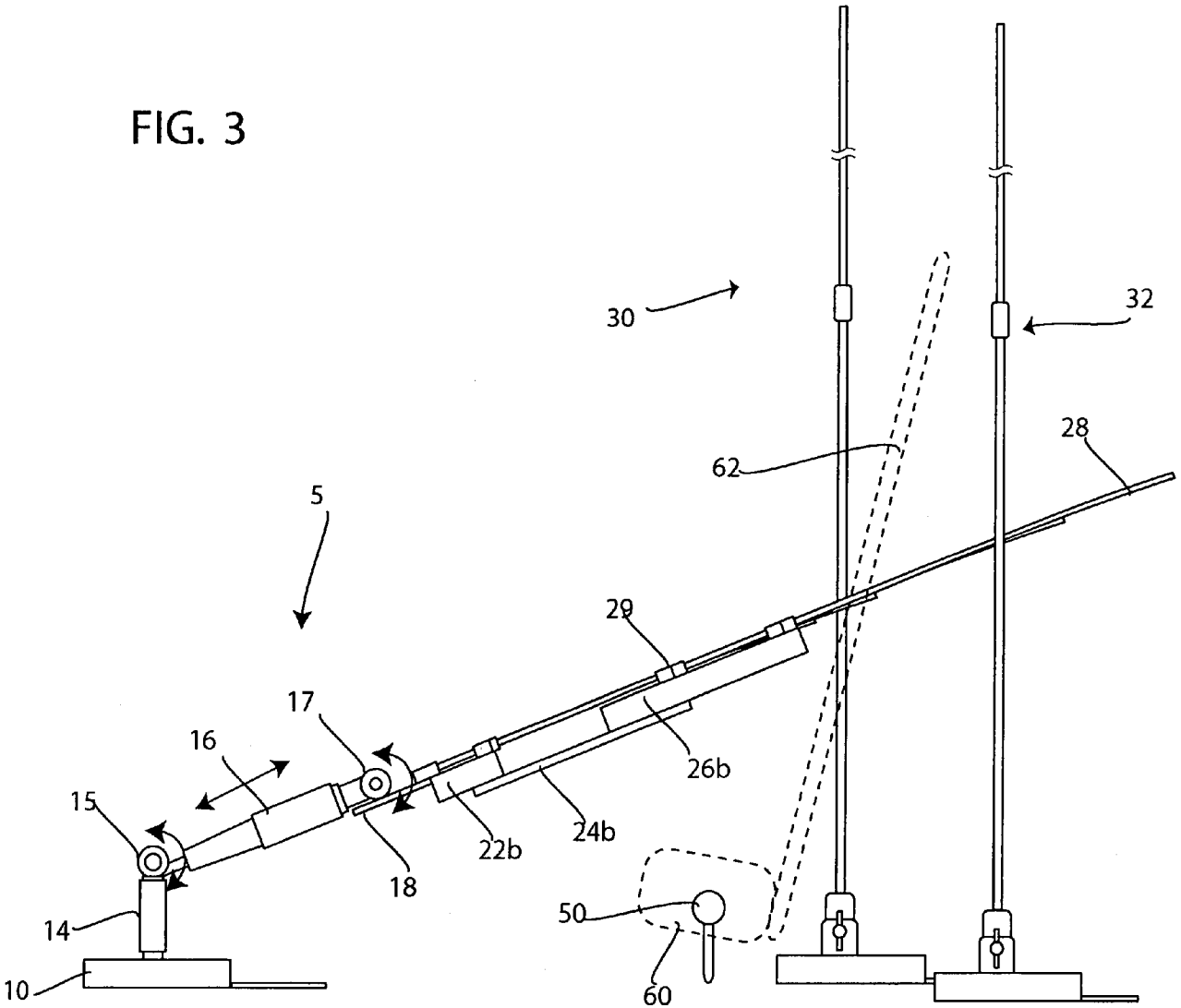
FIG. 3 shows a top view of the device in its expanded form.

FIG. 3 discloses the embodiment as shown in FIG. 1 wherein, in this view, the device is shown in an expanded form such that hinges 23*a*, 23*b*, 27*a* and 27*b* have been opened or expanded out to create the look and feel of an entire swing path. In this view, the device is shown expanded such that outer elements 28 are shown spread out across a substantially semi-circular guide path for a golf club.

Figure 4:
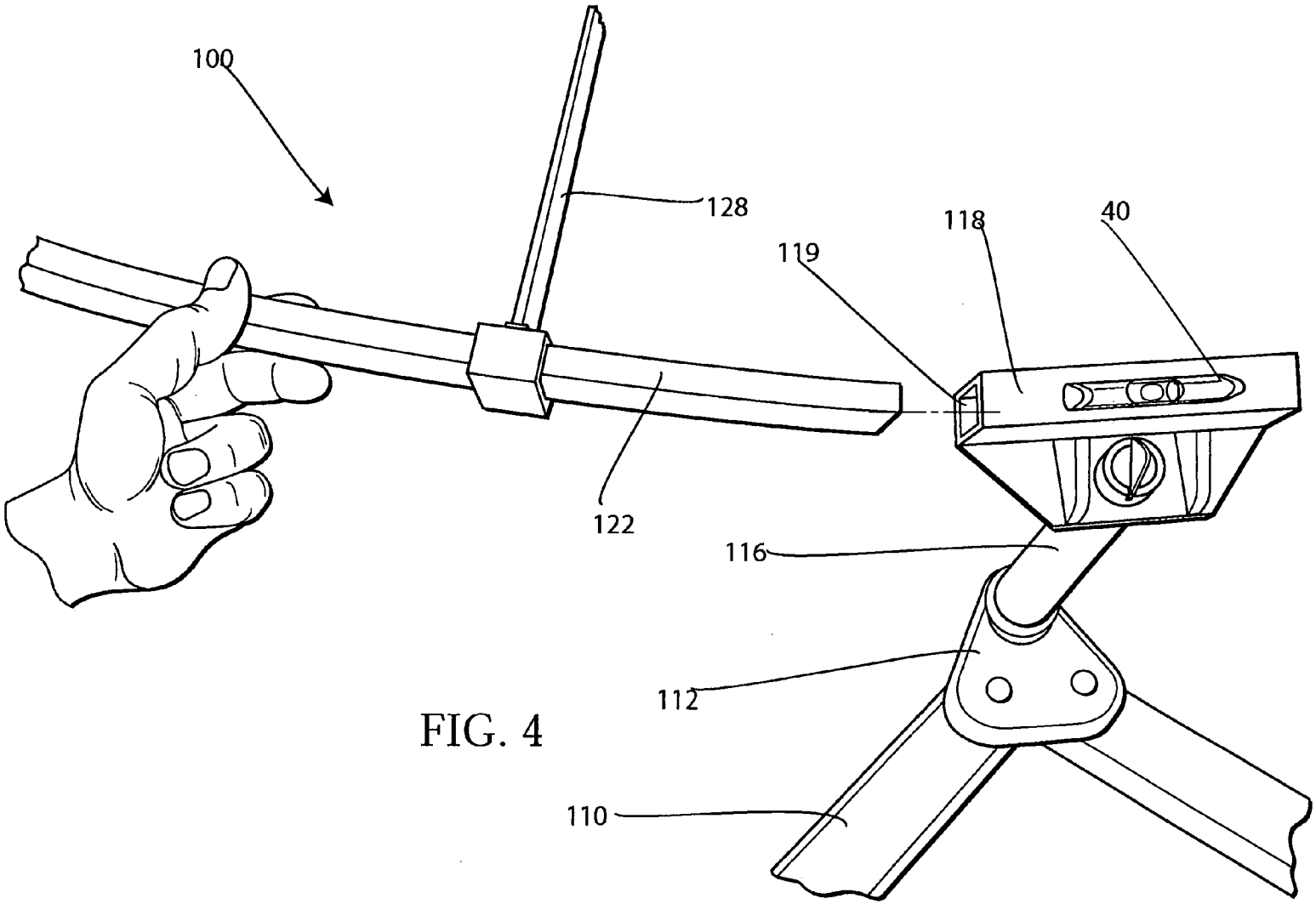
FIG. 4 is a partial view of a second embodiment of the invention.

FIG. 4 shows a perspective view of another embodiment of the invention. With this view, there is shown a base 110 which includes two legs and a coupling bracket 112 which is coupled to the two legs of the base. In this case, there is also a shaft 116 which can be coupled to coupling bracket 112 wherein this shaft 116 extends substantially vertically up to a bracket 118 which serves as a cross bracket. In one embodiment shaft 116 can be formed as a telescoping shaft, wherein in this case, shaft 116 is shown in its fully retracted position. Alternatively, shaft 116 can be fixed in height.

In at least one embodiment there can also be a hinge (not shown) which is used to couple shaft 116 to bracket 118. Alternatively, bracket 118 can be directly coupled to shaft 116. Bracket 118 is adapted to receive a shaft 122 wherein shaft 122 can be inserted into a front end hole 119. There is also a flexible swing guide 128, wherein flexible swing guide 128 can be used to guide a user's swing. Flexible swing guide can be coupled to shaft 122 by securing via a notch in shaft 122. A level 40 can be coupled to a top portion of bracket 118 wherein level 40 can be used to position the guide in place.

Figure 5:
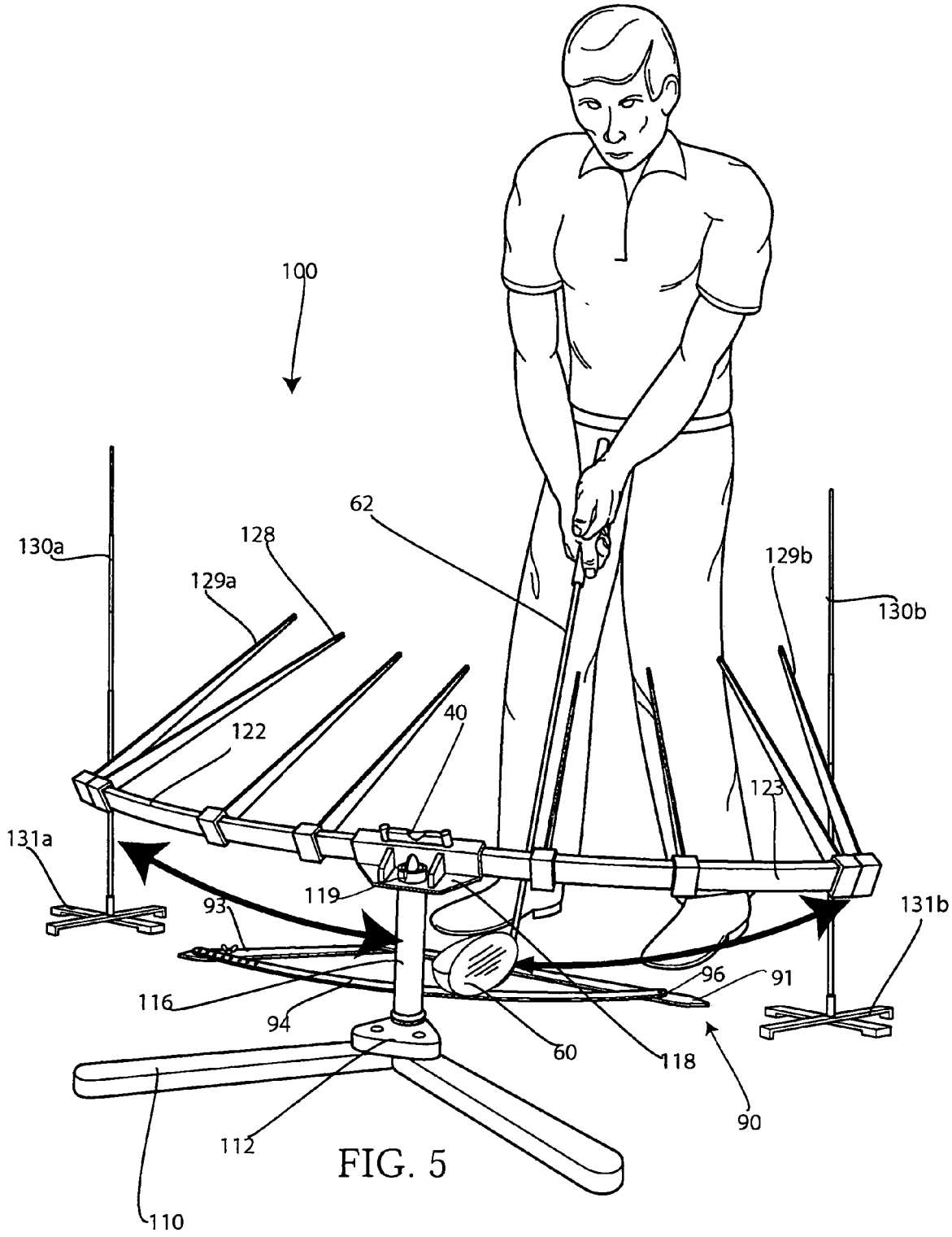
FIG. 5 is a perspective view of another embodiment of the invention wherein this embodiment shows a user swinging a club.

FIG. 5 shows a user using this swing trainer shown in FIG. 4 wherein the user is shown with a golf club 62 which includes a golf club head 60 which passes below flexible swing guides 128. In this case, there are also a plurality of swing trainers 130*a* and 130*b* disposed on either side of the central device, wherein these swing trainers 130*a* and 130*b* are free standing, substantially vertically extending swing trainers which guide or force a user to move his club head in a substantially vertical manner either before or after it has cleared the central device. These swing trainers 130*a* and 130*b* can be formed as telescoping elements that extend up from a base section 131*a* and 131*b* respectively.

In this view as well, there is also another shaft or arm 123 wherein this shaft or arm 123 extends out from bracket 118 in an opposite direction. In this view there are shown a plurality of swing guides 128 which are each coupled to arm or shaft 122 or 123 wherein for example there are four swing guides 128 on each side. The outermost swing guides 129*a* and 129*b* extend out at a different angle relative to the arms than the remaining inner swing guides.

These outer swing guides 128*a* and 128*b* are used to guide the user's swing in a more vertical manner so that the arc of the user's swing is particularly steep at a beginning portion of the swing, bottoming out early in the swing and then extending across in a substantially horizontal manner to sweep across a ball.

There is also a swing guide 90 that rests flat on a ground surface wherein this swing guide 90 includes two substantially straight extending arms or extending elements 91, and 93 which can be connected to each other via a hinge (not shown) wherein these arms extend out in opposite directions from each other. In addition there is shown a curved arm 94 which is coupled to at least one of the arms via a hinge 96. This visual swing guide 90 displays a swing path for a club along the curved arm section 94 wherein this curved arm is for guiding the club head. The two substantially straight extending arms are used to guide a user's hands such that as a golfer's body turns towards the user's backswing, the user's hands would follow the path of arm 93. When the user swings forward, the golf club head follows the path of the curved arm 94, while the user's hands would follow guide arm 91. At the same time the golf club head would remain below guides 129*a*, 128 and 129*b* and avoid swing trainers or guides 130*a* and 130*b*. Thus, this design provides a complete guide to a user's swing.

Accordingly, while at least one embodiment of the present invention have been shown and described, it is to be understood that many changes and modifications may be made thereunto without departing from the spirit and scope of the invention as defined in the appended claims.

What is claimed is:

1. A device for golf instruction comprising:

a) a base;

b) at least one telescoping arm coupled to said base;

c) at least one bracket;

d) at least one selectively adjustable hinge coupling said at least one bracket to said at least one telescoping arm, said selectively adjustable hinge for selectively adjusting said bracket to adjust to at least two different angles;

e) at least one extending arm coupled to said at least one bracket; and f) at least one flexible swing guide member which can be selectively coupled to said at least one extending arm wherein a user can swing a golf club along a swing path to avoid said flexible swing guide member to follow a particular swing path.

2. The device as in claim 1, further comprising at least one additional extending arm coupled to said bracket.

3. The device as in claim 1, further comprising at least one additional rotatable hinge coupled to said at least one telescoping arm opposite said at least one hinge, said at least one additional hinge for coupling said at least one telescoping arm to said base.

4. The device as in claim 1, further comprising a level coupled to said at least one extending arm for determining the position of the extending arm with respect to a substantially horizontal surface.

5. The device as in claim 1, further comprising at least one additional flexible swing guide member selectively coupled to said at least one additional extending arm.

6. The device as in claim 1, further comprising at least one holding element coupled to said stand, said at least one holding element for holding said at least one flexible swing guide to said stand before coupling said flexible swing guide to said at least one extending arm.

7. The device as in claim 1, further comprising at least one vertically extending swing guide comprising a base and a substantially vertically extending arm, wherein said at least one vertically extending swing guide can be placed adjacent to said flexible swing guide member to guide a user's swing underneath the swing guide.

8. The device as in claim 7, wherein said vertically extending arm is in the form of a telescoping arm that extends up from the base.

9. The device as in claim 8, further comprising a hinge, wherein said vertically extending arm is coupled to said base via a hinge.

10. The device as in claim 1, further comprising at least one additional extending arm, and a folding hinge, said at least one additional extending arm being coupled to said at least one extending arm via said folding hinge.

11. The device as in claim 1, wherein said flexible guide members are in the form of rods.

12. The device as in claim 1, wherein said flexible guide members are in the form of substantially flat slats.

13. The device as in claim 12, wherein said flexible guide members comprise at least one additional guide member that extends out from said extending arm at a different angle than an adjacent flexible guide member.

14. The device as in claim 1, further comprising at least one visual guide disposed below said flexible guide members, said visual guide for visually guiding a user's hands during a user's swing.

15. The device as in claim 14, wherein said at least one visual guide is in the form of an adjustable bracket comprising extending elements coupled to each other and at least one curved arm coupled to at least one of the extending elements.

16. A device for golf instruction comprising:

a) a base;

b) at least one telescoping arm coupled to said base;

c) at least one bracket;

d) at least one selectively adjustable hinge coupling said at least one bracket to said at least one telescoping arm, said selectively adjustable hinge for selectively adjusting said bracket to adjust to at least two different angles;

e) at least one extending arm coupled to said at least one bracket; and f) at least one guide means which can be selectively coupled to said at least one extending arm wherein a user can swing a golf club along a swing path to avoid said guide means to follow a particular swing path.

* * * * *

UNITED STATES PATENT AND TRADEMARK OFFICE

CERTIFICATE OF CORRECTION

PATENT NO. : 6,949,030 B1
DATED : September 27, 2005
INVENTOR(S) : Robert Gauer

It is certified that error appears in the above-identified patent and that said Letters Patent is hereby corrected as shown below:

Column 4, line 64 - Column 6, line 41,
Delete all claims and insert the following:

1. A device for golf instruction comprising:

a base;

a shaft coupled to and extending from said base;

at least one extending arm coupled to said shaft at a location spaced from said base, said arm extending in opposite respective directions from said shaft; and a plurality of flexible swing guides selectively coupled to said at least one extending arm at a plurality of spaced apart locations along the extending arm, the flexible swing guides being angled upwardly and towards a user of the device, wherein the user can swing a golf club along a swing path to avoid said flexible swing guides.

2. The device as in claim 1, further comprising a bracket secured to the shaft at a location spaced from the base, the at least one extending arm comprising first and second extending arms coupled to said bracket and extending in substantially opposite directions from said bracket.

3. The device as in claim 1, further comprising at least one rotatable hinge coupled to said shaft between said at least one extending arm and said base.

4. The device as in claim 1, further comprising a level coupled to said at least one extending arm for determining the position of the extending arm with respect to a substantially horizontal surface.

5. The device as in claim 1, further comprising at least one holding element coupled to said base, said at least one holding element for holding said at least one flexible swing guide to said base before coupling said flexible swing guide to said at least one extending arm.

6. The device as in claim 1, further comprising at least one vertically extending swing guide comprising a base section and a substantially vertically extending arm extending from the base section, wherein said at least one vertically extending swing guide can be placed adjacent to said flexible swing guides to guide a user's swing underneath the swing guide.

7. The device as in claim 6, wherein said vertically extending arm is in the form of a telescoping arm that extends up from the base section.

8. The device as in claim 7, further comprising a hinge, wherein said vertically extending arm is coupled to said base section via a hinge.

9. The device as in claim 1, further comprising at least one additional extending arm, and a folding hinge, said at least one additional extending arm being coupled to said at least one extending arm via said folding hinge.

10. The device as in claim 1, wherein said flexible guides are in the form of rods.

11. The device as in claim 1, wherein said flexible guides are in the form of substantially flat slats.

12. The device as in claim 11, wherein said flexible guides comprise at least one additional guide that extends out from said extending arm at a different angle than an adjacent flexible guide.

UNITED STATES PATENT AND TRADEMARK OFFICE

CERTIFICATE OF CORRECTION

PATENT NO. : 6,949,030 B1
DATED : September 27, 2005
INVENTOR(S) : Robert Gauer

It is certified that error appears in the above-identified patent and that said Letters Patent is hereby corrected as shown below:

Column 4, line 64 - Column 6, line 41 (cont'd),

13. The device as in claim 1, further comprising at least one visual guide disposed below said flexible guides, said visual guide for visually guiding a user's hands during a user's swing.

14. The device as in claim 13, wherein said at least one visual guide is in the form of an adjustable bracket comprising extending elements coupled to each other and at least one curved arm coupled to at least one of the extending elements.

15. A device for providing golf instruction to a user, the device comprising:

a base for placement on a supporting surface in front of the user;

a shaft extending from the base and away from the supporting surface;

extending arms extending transversely from a location on the shaft spaced from the base, each of said extending arms extending through an arc that has a concave side;

a plurality of elongate flexible swing guides coupled to said extending arms at spaced apart locations and from the concave side of the respective extending arms; and first and second vertical swing guides each of which has a base section and an elongate vertical section extending up from the base section, the first and second vertical swing guides being disposed in proximity to ends of the extending arms.

16. The device of claim 15, further comprising at least one visual guide disposed below the flexible guides, the visual guide including a curved arm with a concave side facing towards the user for guiding a user's hands during a swing.

Signed and Sealed this

Twenty-fourth Day of January, 2006

JON W. DUDAS
*Director of the United States Patent and Trademark Office*